United States Patent [19]

Mobark

[11] Patent Number: 4,796,408

[45] Date of Patent: Jan. 10, 1989

[54] METHOD AND APPARATUS FOR VACUUM PACKAGING

[75] Inventor: Bengt U. Mobark, Hollviken, Sweden

[73] Assignee: W. R. Grace & Co., Duncan, S.C.

[21] Appl. No.: 78,445

[22] Filed: Jul. 27, 1987

[30] Foreign Application Priority Data

Nov. 14, 1986 [GB] United Kingdom ..... 8627252

[51] Int. Cl.[4] ..... B65B 11/52; B65B 31/02; B65B 47/02; B65B 47/10

[52] U.S. Cl. ..... 53/427; 53/433; 53/453; 53/478; 53/487; 53/509; 53/511; 53/556; 53/559

[58] Field of Search ..... 53/427, 433, 453, 478, 53/487, 511, 509, 141, 556, 559

[56] References Cited

U.S. PATENT DOCUMENTS

| | | | |
|---|---|---|---|
| Re. 29,937 | 3/1979 | Mahaffy et al. | 53/559 X |
| 3,347,011 | 10/1967 | Lovas et al. | 53/433 |
| 3,524,298 | 8/1970 | Hamilton | 53/433 |
| 3,545,163 | 12/1970 | Mahaffy et al. | 53/433 |
| 3,659,393 | 5/1972 | Richter . | |
| 3,694,991 | 10/1972 | Perdue et al. . | |
| 3,835,618 | 9/1974 | Perdue | 53/509 |
| 4,085,565 | 4/1978 | Mahaffy et al. | 53/511 |
| 4,114,348 | 9/1978 | Mahaffy et al. | 53/433 |
| 4,603,541 | 8/1986 | Medwed | 53/559 X |
| 4,676,049 | 6/1987 | Wallter et al. | 53/141 X |

FOREIGN PATENT DOCUMENTS 1042513 9/1966 United Kingdom .

*Primary Examiner*—Horace M. Culver

*Attorney, Agent, or Firm*—John J. Toney; William D. Lee, Jr.; Mark B. Quatt

[57] ABSTRACT

A support tray 6a with a product 11a thereon is covered loosely by a cover sheet 8 in a first chamber portion 12 to be drawn upwardly into contact with the heated walls of a shallow first mould cavity. The combination of the product 11a, support tray 6a and cover sheet 8 is then advanced to a second chamber portion 13 defined by a deeper second mould cavity into which the cover sheet can be drawn while vacuum is applied to the interior of the ensuing pack through slits in the tray 6a, by means of suction ports 20.

15 Claims, 1 Drawing Sheet

METHOD AND APPARATUS FOR VACUUM PACKAGING

The present invention relates to a method of and apparatus for vacuum packaging, in particular for forming vacuum packages in which a product is placed between two layers of plastics material and the atmosphere between the two sheets is evacuated and the overlying perimeters of the two sheets are sealed together to close the package.

It is known to provide vacuum packs by placing an article on a support layer and then drawing down a pre-heated layer of plastic film into contact with the product in a vacuum environment, so as to form a vacuum package. The pre-heating of the upper layer of the film material may be by way of radiation, or by way of conduction as in the case of GB-A-No. 1,307,054 where the heat is applied to the cover film by drawing the cover film into contact with the walls of a heated cavity mould placed above the article and then, when the film has acquired adequate heat by conduction from the mould, releasing it on to the product article therebelow.

Such a process is particularly convenient for thermoforming the cover film closely into contact with the contours of the product article, but it has been found that the appearance of the pack suffers when the product article used is a relatively tall one and a deep drawing action is required in order to impart heat to the film. Also, the film thickness of the deep drawn cover film becomes non-uniform.

It is an object of the present invention to overcome this problem.

Accordingly, one aspect of the present invention provides a vacuum packaging process, comprising placing a product between two sheets of plastic film; drawing one of the sheets of film away from the product into contact with a heated mould cavity for both partly deforming the sheet and heating it by conduction; and then drawing said one of the film sheets into a deeper mould cavity for further deforming said one film sheet away from the product; subjecting the space between the two film sheets to vacuum; and causing the said one sheet to contact the product and the other film sheet to form a sealed pack.

A further aspect of the present invention provides vacuum packaging apparatus, comprising a support base for a support sheet of thermoplastic film with a product article thereon; means defining first and second downwardly open mould cavities for covering said support base, said first mould cavity being shallower than said second mould cavity; means for drawing a cover sheet of thermoplastic film material into contact with the walls of said first and second mould cavities; means for heating the mould cavities to elevated temperatures so as to be able to impart heat by conduction to a cover sheet drawn into contact with said mould cavities; means for sequencing the positioning of the mould cavities and a product and support sheet combination on said support base whereby said product and support sheet combination is first of all covered by said first mould cavity and then covered by said second mould cavity, such that a cover sheet overlying the product and support sheet combination is first of all drawn into contact with the heated walls of said first mould cavity and then drawn into contact with the heated walls of said second mould cavity; and means for bringing the cover sheet from a position of contact with the heated walls of said second mould cavity into contact with said support sheet and the product thereon.

A further aspect of the present invention provides a mould chamber cover for use in vacuum packaging apparatus, comprising a mould body defining first and second mould cavities, said first mould cavity being shallower than said second mould cavity, and including first vacuum ports communicating with said first mould cavity and second vacuum ports communicating with said second mould cavity, and respective heating means for elevating the temperatures of the walls of said first and second mould cavities.

Using such a mould cover, it is possible to convert an existing vacuum packaging machine to operate in accordance with the process of the present invention.

In order that the present invention may more readily be understood the following description is given, merely by way of example, with reference to the accompanying drawing in which.

Figure 1:
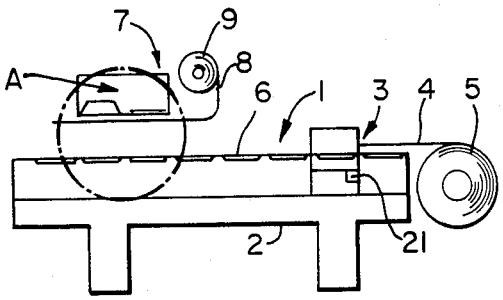
FIG. 1 is a general arrangement view of a packaging machine in accordance with the present invention.
Figure 2:
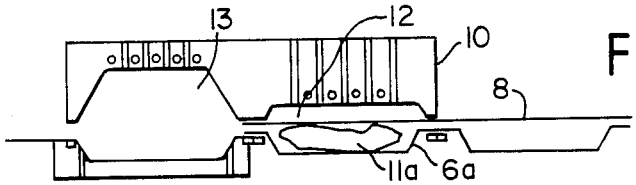
FIG. 2 is a detail of the region A shown within the circle surrounding the evacuation and closing station in FIG. 1, but showing an early stage in the packaging process.
Figure 3:
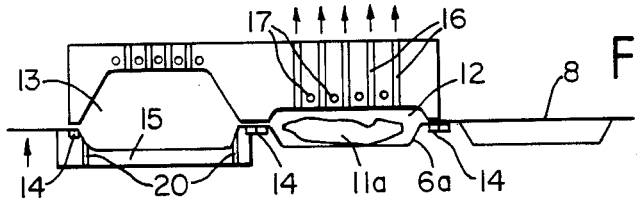
FIG. 3 is a view similar to FIG. 2 but showing a later stage in the packaging process.
Figure 4:
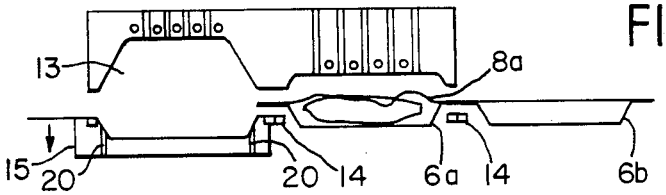
FIG. 4 is a view similar to FIGS. 2 and 3 but showing a third stage in the packaging process.
Figure 5:
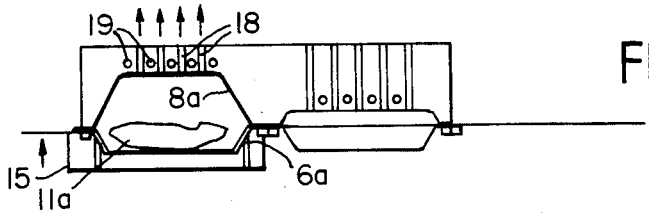
Figure 6:
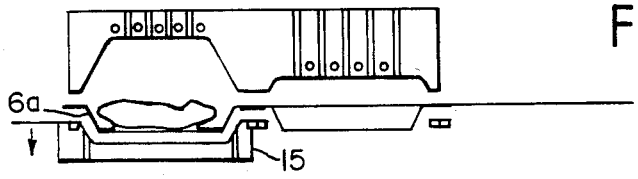

FIG. 5 again corresponds to FIGS. 1 to 3 but shows a fourth stage in the packaging process; and FIG. 6 is similar to FIGS. 2 to 5 but illustrates the final stage when the mould is being opened ready for discharge of the closed package.

FIG. 1 shows a packaging machine 1 comprising a support table 2 having a thermoforming station 3 for converting a thermoformable lower packaging web 4 from a supply roll 5 into a plurality of thermoformed upwardly open trays *6a*, *6b* etc. ready to receive products to be inserted therein by hand.

The trays, after having been filled, pass to a closing station 7 where a cover film 8 from a supply roll 9 is formed into the configuration of a cover which seals to the trays *6a*, *6b* etc. complete the vacuum packages, as will be described below with reference to FIGS. 2 to 6.

Finally, the packages are removed manually from the left hand end of the support table 2.

If desired, loading of the trays *6a*, *6b* etc. and delivery of the finished packages may be accomplished automatically, and the means for achieving this will be well within the capabilities of the skilled reader and require no detailed explanation herein.

The elements of the evacuation and closing station 7 surrounded by the circle A in FIG. 1 are illustrated in each of FIGS. 2 to 6 which show the operating sequence of the machine.

FIG. 2 shows the vacuum chamber cover 10 in a partially closed configuration, having just admitted a loaded tray *6a* supporting a product *11a* into a right hand portion 12 of the chamber. The portion 12 serves as a pre-heating chamber for the cover film 8 and is topped by a relatively shallow mould cavity in the cover 10.

Relative vertical movement between the chamber cover 10 and the lower support 15 can be actuated automatically by any suitably programmed drive means (not shown).

By the time the FIG. 3 configuration is reached, the lower transverse clamping gasket at the inlet end and along the sides of the right hand chamber portion 12, and the lower gasket 14 around the left hand chamber 13 have risen, together with a support base 15 under the left hand, second chamber portion 13. The result of this will be to clamp the support film 6 and the cover film 8 around the perimeters of the first and second chamber portions 12 and 13.

At this stage, illustrated in FIG. 3, suction is applied to a succession of suction ports 16 communicating with the right hand first chamber portion 12 so as to draw the cover film 8 therein upwardly into contact with the relatively shallow mould cavity defined in the underside of the chamber cover 10.

This same relatively shallow mould cavity is heated to an elevated temperature by the effect of electrical resistance heaters 17 embedded in the chamber cover 10 between the suction ports 16.

Although not specifically illustrated in the drawings, at the thermoforming station 3 is a cutting means for forming slits in the tray 6*a*, preferably in the side walls thereof just beside the horizontal perimeter flange.

Once an adequate dwell time of the cover film 8 in contact with the cavity bounding the right hand chamber portion 12 has elapsed, the clamping gaskets 14 and the product support base 15 are lowered through the FIG. 4 configuration, sufficient to allow the tray 6*a* with its loose cover 8*a* to be transferred leftwardly by film advancing means (not shown) into the left hand chamber portion 13 and to allow the next tray 6*b*, from which the product has been omitted for purposes of clarity of the drawing, to enter the right hand chamber portion 12. This transfer of the loaded tray 6*a* to the left hand, second chamber portion 13 allows a second stage heating and drawing step to be carried out on the cover 8*a* as can be seen from FIG. 5.

This second stage drawing operation is more pronounced in that the cavity defining the second chamber portion 13 is much deeper than that defining the first chamber portion 12 and consequently the application of suction through suction ports 18 communicating with the second chamber portion 13 causes the firm to undergo much more extensive deformation and to contact the cavity wall which is heated by further electrical resistance heaters 19, but in this case to a more elevated temperature which thereby prepares the film for a final stage of the process in which the thus heated and stretched film is allowed to drape on to the product 11*a* to arrive at the FIG. 6 configuration.

FIG. 6 shows the situation while the product support 15 and the gasket 14 are descending to open the chamber and hence to allow the tray 6*a* to be discharged from the package evacuation and closing station 7.

As indicated above, GB-A-No. 1,307,054 discloses a process in which the cover sheet is drawn into a heated cavity and then released on to the surface of the article, in the way which is used in the second chamber portion 13 of FIGS. 2 to 6. However, the deep profile of the second chamber portion 13, for example as shown in FIG. 2, requires considerable stretching of the film with the result that the film thickness reduces substantially in the areas corresponding to the inclined side walls of the cavity as compared with the relatively slight reduction (if any) in the part corresponding to the flat floor of the cavity.

Whereas it may be obvious to tackle this problem by pre-heating the cover sheet with radiant heaters, for example before entering the mould cavity, although this has the advantage of rendering the film sufficiently warm to allow better homogeneity of the film thickness as it contacts the mould, we have found that uniformity of temperature at a partially elevated level is not enough to prevent variations in wall thickness.

In accordance with the present invention the cover film 8 is pre-heated by a partial deformation in the relatively shallow first mould cavity forming the roof of the first chamber portion 12, and thus not only is the film heated to a substantially uniform temperature which is less than that required in the second chamber portion 13, it is also partially deformed so that the second stage deformation occurring when the cover film material 8 has advanced into the second chamber portion 13 is simply emphasizing the partial deformation derived in the FIG. 3 configuration and is therefore less likely to cause thinning of the film and is also unlikely to cause unsightly hazing of the film.

For the film to be capable of withstanding the deformation in the two chambers and the heating occurring at the same time through contact with the hot cavity walls, it is advantageous for the film to have been cross-linked by irradiation. One example of a film which is particularly suitable for the process in accordance with the present invention is a DARFRESH film which is commercially available from W. R.Grace & Co. DARFRESH is a Trade Mark.

The sealing action in the process results from the contact of the hot cover film 8*a* in the second chamber portion 13 as it is released from the FIG. 5 configuration to the FIG. 6 configuration into contact with the slit tray which has moved leftwardly into the second chamber 13. The existence of the pre-formed slits in the tray allows suction, drawn through the ports 20 in the base plate 15, to extract residual air from within the tray 6*a*, thereby evacuating the interior of the package. This action occurs after suction has been applied on the ports 18 to draw the cover sheet 8*a* into contact with the deep cavity in the second mould cavity serving as the roof of the second chamber portion 13, so that when the suction through the upper ports 18 is released the cover film 8*a* is allowed to descend right on to the product 11*a* and the tray 6*a* so as to provide an all-enveloping vacuum pack as shown in FIG. 6. The action of the cover sheet 8*a* coming into contact with the floor of the tray 8*a* both closes the pack and closes off the slits which were pre-formed in the first chamber portion 12 in the FIG. 3 stage of the process.

The closed-off slit region can then be trimmed as a final stage of the packaging process, to leave a neat vacuum pack.

It should be understood that it is possible to modify the package evacuation and closing station 7 of a conventional vacuum packaging machine by replacing the present single cavity mould with the modified dual cavity mould 10 shown in FIGS. 2 to 6. All that is required then are (a) the electrical control for the two sets of heaters 17 and 19, and (b) additional suction to the suction ports 16 of the first chamber portion 12 (it being remembered that there will in any case be means for applying suction to the second chamber portion 13 in that the conventional single cavity mould as exemplified in GB-A-No. 1,307,054 requires means for applying suction to draw the film into contact with the mould cavity).

It is thus possible to provide, by means of the chamber cover 10, ready means for converting a conventional vacuum packaging machine to a machine in accordance with the present invention.

I claim:

1. A vacuum packaging process, comprising placing a product between two sheets of plastic film; drawing one of the sheets of film away from the product into contact with a heated mould cavity for both partly deforming the sheet and heating it by conduction; and then drawing said one of the film sheets into a deeper mould cavity for further heating and deforming said one film sheet away from the product; subjecting the space between the two film sheets to vacuum; and causing the said one sheet to contact the top and sides of the product thereby moulding said one sheet to the shape of the product and causing said one sheet to contact the other film sheet to form a sealed pack.

2. A process according to claim 1, wherein the two films are in a generally horizontal configuration, wherein said other film sheet forms a support on which the product is supported, and said one film sheet is used to define a cover for the product.

3. A process according to claim 2, wherein said other film sheet, defining the support, is thermoformed to form an upwardly open tray for supporting the product.

4. A process according to claim 1 wherein the wall temperature of said deeper cavity is higher than the wall temperature of the first-mentioned cavity.

5. A process according to claim 1 wherein vacuum is applied to the interior of the pack by way of at least one aperture, and said at least one aperture is closed by subsequent contact of the said one film sheet with said other film sheet after release from the deeper configuration cavity mould.

6. A process according to claim 1 wherein the thermoplastic film material used for said one film sheet is a multi-layer film.

7. A process according to claim 6 wherein said thermoplastic film material used for said one film sheet has at least one layer which has previously been cross-linked, preferably, by irradiation treatment.

8. A vacuum packaging apparatus, comprising a support base for a support sheet of thermoplastic film with a product article thereon; means defining first and second downwardly open mould cavities for covering said support base, said first mould cavity being shallower than said second mould cavity; means for drawing a cover sheet of thermoplastic film material into contact with the walls of said first and second mould cavities; means for heating each of the mould cavities to elevated temperatures so as to be able to impart heat by conduction to substantially the entire surface of that portion of a cover sheet drawn into contact with said mould cavities; means for sequencing the positioning of the mould cavities and a product and support sheet combination on said support base whereby said product and support sheet combination is first of all covered by said first mould cavity and then covered by said second mould cavity, such that a cover sheet overlying the product and support sheet combination is first of all drawn into contact with the heated walls of said first mould cavity and then drawn into contact with the heated walls of said second mould cavity; and means for bringing the cover sheet from a position of contact with the heated walls of said second mould cavity into contact with the top and sides of the product to mould the cover sheet to the shape of the product and into contact with the support sheet.

9. Apparatus according to claim 8, wherein said means for bringing the cover sheet into contact with the heated walls of said first and second mould cavities comprise suction ports in said first and second mould cavities, communicable with a source of suction when the cover sheet overlying the product and support sheet combination is positioned in register with said first mould cavity and said second mould cavity, respectively.

10. Apparatus according to claim 9 and including means for forming at least one aperture in said support sheet prior to bringing said product and support sheet combination and the overlying cover sheet into register with said second mould cavity; and further including means for drawing a vacuum through said at least one aperture when said product and support sheet combination is in register with said second mould cavity.

11. Apparatus according to claim 10 wherein said support base is adapted to be in register with both said first and second mould cavities, simultaneously, and wherein said means for bringing said first and second mould cavities in sequence over said product and support sheet combination on the support base comprises means for advancing said product and support base combination from a first position underneath said first mould cavity to a second position underneath said second mould cavity.

12. Apparatus according to claim 11 and including means under said first mould cavity for slitting said support sheet when the product and support sheet combination is in register with said first mould cavity, and including suction ports under said second mould cavity communicating with said support base for drawing vacuum through the slits formed by said slitting means, for the purposes of evacuating the interior of the pack defined by a said support sheet and cover sheet surrounding a said product.

13. Apparatus according to claim 12 and including means for controlling the elevated temperatures imparted by the heating means associated with said first and second mould cavities such that the elevated temperature attained by said second mould cavity is higher than the elevated temperature attained by said first mould cavity.

14. Apparatus according to claim 13 wherein said support base is shaped to receive an upwardly open support tray of said support sheet material, and further including means for thermoforming said support sheet material to form a said tray before the said support sheet comes into register with said first mould cavity.

15. A mould chamber cover for use in vacuum packaging apparatus, comprising a mould body defining first and second mould cavities for receiving a sheet of thermoplastic film said first mould cavity being shallower than said second mould cavity and said second mould cavity being adapted to receive a sheet of film from the first cavity, said cavities including first vacuum ports communicating with said first mould cavity and second vacuum ports communicating with said second mould cavity, and respective heating means for elevating the temperatures of the walls of said first and second mound cavities to heat substantially the entire surface of a sheet of film which is in contact with a mould wall.

* * * * *